United States Patent [19]

Frost, Jr.

[11] 4,217,111

[45] Aug. 12, 1980

[54] FUEL COMPOSITIONS CONTAINING DIALKYL FORMAMIDES

[75] Inventor: Kenneth A. Frost, Jr., San Rafael, Calif.

[73] Assignee: Chevron Research Company, San Francisco, Calif.

[21] Appl. No.: 644,359

[22] Filed: Dec. 24, 1975

[51] Int. Cl.[2] ..... C10L 1/22

[52] U.S. Cl. ..... 44/71

[58] Field of Search ..... 44/71, 58

[56] References Cited

U.S. PATENT DOCUMENTS

| | | | |
|---|---|---|---|
| 2,706,677 | 4/1955 | Duncan | 44/71 |
| 2,887,514 | 5/1959 | Schmerling | 44/71 |
| 2,918,359 | 12/1959 | Lovett et al. | 44/56 |
| 3,778,372 | 12/1973 | Murphy | 44/71 |
| 4,022,589 | 5/1977 | Alquist et al. | 44/71 |

*Primary Examiner*—Winston A. Douglas
*Assistant Examiner*—Y. Harris-Smith
*Attorney, Agent, or Firm*—C. J. Tonkin; D. L. Hagmann

[57] ABSTRACT

Fuel compositions are provided which possess octane requirement moderating properties and comprise a major portion of a hydrocarbon boiling in the gasoline range and a minor portion of a dialkyl formamide of 7 to 11 carbon atoms.

3 Claims, No Drawings

FUEL COMPOSITIONS CONTAINING DIALKYL FORMAMIDES

BACKGROUND OF THE INVENTION

2. Field of the Invention

This application refers to fuel compositions particularly useful in internal combustion engines and more particularly useful in spark ignition engines.

With the advent of automobile engines that require the use of non-leaded gasolines (to prevent disablement of catalytic converters used to reduce undesirable emissions), a serious problem has arisen in providing gasoline of high enough octane to prevent knocking and the concomitant damage which it causes. The chief problem lies in the area of the degree of octane requirement increase, herein called "ORI", which is caused by deposits formed in the combustion chamber while the engine is operating on commercial gasolines.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated on the same fuel for a prolonged period will reach equilibrium. This is apparently caused by an amount of deposits in the combustion chamber. Equilibrium is typically reached after 5000 to 15,000 miles of automobile operation.

Octane requirement increases at equilibrium with commercial gasolines, in particular engines will vary from 5 or 6 octane units to as high as 12 or 13 units, depending upon the gasoline compositions and engine design. The seriousness of the problem is thus apparent. A typical 1975 or 1976 automobile with an octane requirement of 85 may after a few months of operation require 97 octane gasoline for proper operation, and little unleaded gasoline of that octane is available. The ORI problem exists in some degree with engines operated on leaded fuels. U.S. Pat. Nos. 3,144,311 and 3,146,203 disclose lead-containing fuel compositions having reduced ORI properties.

It is, however, believed by many experts that the ORI problem, while present with leaded gasolines, is much more serious with unleaded fuel because of the different nature of the deposits formed with the respective fuels, and because of the lesser availability of high-octane non-leaded fuels. This problem is compounded by the fact that the most common means of enhancing the octane of unleaded gasoline, increasing its aromatic content, also appears to increase the octane requirement of the engine.

It is thus highly desirable to provide lead-free fuel compositions which moderate the octane requirement increases achieved when operated in typical modern automotive engines.

2. Description of the Prior Art

U.S. Pat. No. 2,706,077 discloses gasoline compositions containing lower dialkyl formamides, particularly dimethyl and diethyl formamide, as antistalling additives. Only dimethyl formamide was tested and claimed.

U.S. Pat. No. 2,918,359 discloses gasolines containing a synergistic antistalling composition comprising a lower N,N-disubstituted formamide and a lower alkanol. The formamides are disclosed as having from 1- to 7-carbon alkyl groups; N,N-diethyl, N,N-di-N-propyl, N,N-diisopropyl and N-methyl-N-ethyl are specifically disclosed. Only gasolines containing the combination of dimethyl formamide and isopropanol were tested and claimed.

SUMMARY OF THE INVENTION

Gasolines compositions are provided which contribute a minimum of increased octane requirement in engines in which they are used compared with engines operated with conventional fuels. The fuel compositions comprise a major portion of a hydrocarbon distillate fuel boiling in the gasoline range, and a minor portion, sufficient to moderate the octane requirement of an engine operated with the fuel, of dialkyl formamide of the formula

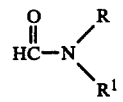

in which R and $R^1$ are alkyl of 1 to 9 carbon atoms and the sum of the carbon atoms in R and $R^1$ is from 7 to 11. The compositions will contain not more than about 0.1 g of lead per gallon, preferably not more than about 0.005 g per gallon. The quantity of formamide employed in order to moderate and stabilize the octane requirement of the engine will usually be in the range of about 800 to 10,000 ppm, preferably from about 1000 to 3000 ppm.

In another embodiment, when it is desired to remove previously formed deposits from the engine combustion chamber, the engine is operated with a fuel composition containing a very high concentration of formamide, up to about 15 weight percent. These "clean-up" fuel compositions will thus contain amounts of the formamides in the range 3 to 15, preferably 5 to 12, weight percent.

Examples of the dialkyl formamide Octane Requirement Reducing (ORR) additives which may be employed in the compositions of this invention include N-methyl-N-hexyl formamide, N-methyl-N-octyl formamide, N-methyl-N-decyl formamide, N-ethyl-N-pentyl formamide, N-ethyl-N-heptyl formamide, N-ethyl-N-nonyl formamide, N-propyl-N-butyl formamide, N-propyl-N-heptyl formamide, N-propyl-N-octyl formamide, N,N-dibutyl formamide, N-butyl-N-pentyl formamide, N-butyl-N-heptyl formamide, N,N-dipentyl formamide, N-pentyl-N-hexyl formamide, etc.

The alkyl groups of dialkyl materials can be either straight- or branched-chain. Thus, in addition to the normal alkyl radicals, other branched-chain radicals such as isopropyl, isobutyl, tertiary butyl, isoamyl, etc., may be employed.

In order to demonstrate the improvement in moderating the octane requirement increase obtained with the fuel compositions, a Multicylinder Octane Requirement Test was employed. The test uses a 350-CID Chevrolet V-8 engine. The test procedure involves engine operation for 100 hours on a prescribed load and speed schedule representative of typical vehicle driving conditions. The engine is stopped and force-cooled by circulation of cold water for a period of one-half hour during each four hours of operation. The test is started with clean combustion chambers and the engine octane requirement is measured at the start of the test and at daily intervals thereafter as combustion chamber deposits accumulate. The engine ignition system is equipped with electronic circuitry, permitting the operator to retard the ignition timing of selected individual cylinders during the octane requirement measuring procedure, thus obtaining the requirement for each cylinder. The cycle for engine operation during the test is as follows:

DEPOSIT ACCUMULATION CYCLE
CHEVROLET 350-CID V-8

| | Time in Mode, sec. | Manifold Vacuum, in. Hg | Engine Speed, RPM |
|---|---|---|---|
| 1. Idle | 20 | 17 | 600 |
| 2. Accel. to 35 mph | 16 | 11 | — |
| 3. Cruise at 35 mph | 20 | 16 | 1500 |
| 4. Cruise at 55 mph | 59 | 14 | 2050 |
| 5. Idle | 48 | 17 | 600 |
| 6. Accel. to 30 mph | 19 | 10 | — |
| 7. Cruise at 40 mph | 118 | 17 | 1600 |
| 8. Cruise at 30 mph | 60 | 16 | 1400 |

The gasoline employed in the test was representative of commercial unleaded fuel which, however, contained a relatively low concentration of heavy aromatic hydrocarbons. The formamides to be tested were added to the fuel at concentrations of 2500 ppm. The following table sets forth the results achieved with the various formamides.

MULTICYLINDER OCTANE INCREASE TEST
350-CID CHEVROLET V-8 LABORATORY ENGINE[1]

| | Additive at 2500 ppm ORI at 100 Hours | | | | | | | | |
|---|---|---|---|---|---|---|---|---|---|
| | Cylinder | | | | | | | | |
| Additive | 1 | 2 | 3 | 4 | 5 | 6 | 7 | 8 | Average |
| None | 5.2 | 5.0 | 5.7 | 2.8 | 5.3 | 4.6 | 5.7 | 5.4 | 5.0 |
| Dibutylformamide | 2.5 | 0.8 | 6.3[2] | 0.4 | 1.7 | 0.7 | 2.1 | 2.5 | 2.1,1.4[3] |
| Repeat run - DBF | 4.4 | 4.2 | 3.3 | 2.6 | 3.0 | 1.1 | 5.1[2] | 1.7 | 3.1,2.8[3] |
| Dimethylformamide | 4.0 | 3.8 | 6.2 | 4.3 | 6.0 | 3.6 | 4.0 | 5.5 | 4.6 |
| Dipropylformamide | 4.1 | 3.2 | 4.0 | 3.8 | 4.0 | 2.4 | 6.4 | 3.5 | 3.9 |

[1]Engine equipped for individual cylinder octane requirement measurement
[2]Defective valve stem oil seal found at end of test
[3]Defective cylinder result excluded from average As can be seen from the above data, the addition of dibutyl formamide to the fuel resulted in a substantial reduction in octane requirement increase compared with base fuel. Note that cylinder 3 in the first dibutyl formamide run and cylinder 7 in the second run had leaking valve stem oil seals, which apparently caused abnormally high ORI's in those cylinders. However, even including these values, a substantial reduction in ORI was obtained with the additive.

In addition to the reduction in ORI obtained with the formamides, an actual reduction in the octane requirement of an engine having octane-increasing deposits can be effected using generally larger quantities of the formamides.

An automobile was operated for 264 miles on a typical non-leaded commercial fuel containing 10% by weight of N,N-dibutyl formamide. The automobile, which had 13,010 operating miles on its engine, had an OR of 91. At the end of the test, the OR was 90.

In addition to the Octane Requirement Reducing additives, the compositions may contain a variety of conventional gasoline additives. These include carburetor detergents, dyes, oxidation inhibitors, etc. It should be noted, however, that the formamides have been found to be incompatible with several of the conventional "deposit control" additives which are designed to reduce deposits in the intake systems of engines, particularly on ports and intake valves. The use of these materials which contain nitrogen and are polymeric, such as polybutene amines, polybutene carboxamides, alkenyl succinimides, some of which have been used commercially in modern gasolines, negate the ORR activity of the formamides and in turn have their deposit control activity reduced by the presence of the formamides. Thus, the preferred compositions do not contain the conventional nitrogen-containing, polymeric deposit control additives.

What is claimed is:

1. An unleaded gasoline fuel composition, containing less than 0.1 g of lead per gallon, comprising a major amount of a hydrocarbon distillate fuel boiling in the gasoline range and a minor amount, sufficient to moderate the octane requirement of an engine operated with said composition, of a dialkyl formamide in which said alkyl groups each contain from 1 to 9 carbon atoms and the total number of carbon atoms in said alkyl groups is from 7 to 11, said composition being essentially free of nitrogen-containing, polymeric, deposit control additives.

2. The unleaded gasoline fuel composition of claim 1 wherein said dialkyl formamide is dibutyl formamide.

3. A concentrate useful for reducing the octane requirement of an engine having accumulated cylinder deposits comprising the composition of claim 1 wherein the concentration of dialkyl formamide is from about 3 to 15 percent by weight.

* * * * *